US005308300A

United States Patent [19]

Chino et al.

[11] Patent Number: 5,308,300

[45] Date of Patent: May 3, 1994

[54] STEP-TYPE TRAINING MACHINE AND CONTROL METHOD

[75] Inventors: Takashi Chino; Hideo Hata; Kazuhiko Arai; Masao Ito, all of Tokyo, Japan

[73] Assignee: Combi Corporation, Tokyo, Japan

[21] Appl. No.: 792,633

[22] Filed: Nov. 15, 1991

[30] Foreign Application Priority Data

| | | | |
|---|---|---|---|
| Nov. 15, 1990 | [JP] | Japan | 2-307265 |
| Nov. 19, 1990 | [JP] | Japan | 2-314987 |
| Jul. 30, 1991 | [JP] | Japan | 3-189967 |

[51] Int. Cl.[5] ..... A63B 22/04

[52] U.S. Cl. ..... 482/52; 482/6; 482/900; 482/903; 73/379.08; 74/138; 601/36

[58] Field of Search ..... 482/1, 4, 5, 6, 7, 8, 482/51, 52, 54, 70, 121, 900–903; 128/25 R, 25 B; 73/379, 379.01, 379.08; 74/138

[56] References Cited

U.S. PATENT DOCUMENTS

| | | | |
|---|---|---|---|
| 3,934,269 | 1/1976 | Fujita et al. | 388/812 X |
| 4,574,649 | 3/1986 | Seol | 74/138 |
| 4,678,182 | 7/1987 | Nakao et al. | 482/9 |
| 4,679,786 | 7/1987 | Rodgers | 482/54 X |
| 4,708,338 | 11/1987 | Potts | 482/901 X |
| 4,720,093 | 1/1988 | Del Mar | 482/70 X |
| 4,790,528 | 12/1988 | Nakao et al. | 482/901 X |
| 4,800,310 | 1/1989 | Nakao et al. | 482/4 X |
| 4,817,938 | 4/1989 | Nakao et al. | 482/4 |
| 4,911,427 | 3/1990 | Matsumoto et al. | 482/3 X |
| 4,919,416 | 4/1990 | DeCloux | 482/54 X |
| 4,938,474 | 7/1990 | Sweeney et al. | 482/902 X |
| 4,949,993 | 8/1990 | Stark et al. | 482/52 |
| 4,998,725 | 3/1991 | Watterson et al. | 482/902 X |
| 5,013,031 | 5/1991 | Ball | 482/52 |

FOREIGN PATENT DOCUMENTS

| | | |
|---|---|---|
| 0131088 | 1/1985 | European Pat. Off. . |
| 0193286 | 9/1986 | European Pat. Off. . |
| 0255142 | 7/1987 | European Pat. Off. . |
| 0379227 | 7/1990 | European Pat. Off. . |
| 8904696 | 6/1989 | World Int. Prop. O. . |
| 9007363 | 7/1990 | World Int. Prop. O. . |

*Primary Examiner*—Richard J. Apley
*Assistant Examiner*—Joe H. Cheng
*Attorney, Agent, or Firm*—Sughrue, Mion, Zinn, Macpeak & Seas

[57] ABSTRACT

A step-type training machine in which the exerciser trains using a predetermined load while detecting the pulse of the exerciser, and in accordance with data (e.g. the age, sex and weight) inputted before the training and various data (e.g. the exerciser's pulse) during the training, the step load is varied and controlled during the training so as to impart the optimum exercise load to the exerciser. The machine includes a frame; a plate for mounting various parts at a lower portion of the frame; a pair of crankarms each pivotally mounted by a pivot shaft on the plate and having a step member mounted on its one end movable up and down through a predetermined angle; an eddy current load device rotated by the swinging movement of the pair of crankarms; an input device for inputting individual data of the exerciser; a mechanism for measuring the pulse value of the exerciser; a detector for detecting the rotation frequency of the load device; a processor for extracting a control signal; and a display for displaying predetermined date extracted by the processing means.

7 Claims, 13 Drawing Sheets

| FIG. 4-1 |
| --- |
| FIG. 4-2 |

※ ΔHR=HR−THR
※ A1, B1 : CONSTANT

STEP-TYPE TRAINING MACHINE AND CONTROL METHOD

BACKGROUND OF THE INVENTION

This invention relates to a step-type training machine in which an exercise load is set by a heart rate, and by feeding back the heart rate during exercise, the braking force of a brake load means is automatically controlled so that the exercise load can be maintained at a level suited for the level of the physical strength of an individual exerciser. The invention also relates to a method of controlling this training machine.

More specifically, the invention relates to a step-type training machine in which the exerciser exercises under a predetermined load while detecting the pulse of the exerciser, and in accordance with data (e.g. the age, sex and weight) inputted before the training and various data (e.g. the exerciser's pulse) during the training, the step load is varied and controlled during the training so as to impart the optimum exercise load to the exerciser. In this manner, the exerciser can perform aerobic exercise efficiently and safely and also can perform isokinetic exercise in a stable manner because of the exercise speed control, thereby enabling the exerciser to execute the training without experiencing any excess load on the joints.

Recently, there have been developed various training machines intended for improving the physical strength of the young as well as the old. For example, there is known a training machine of a so-called upstairs-type in which there are provided a pair of right and left crank pedals which can be driven up and down, and the driving of the right and left crank pedals is transmitted to a load means such as a rheostatic brake, so that the up-and-down driving of the crank pedals can be controlled. In the conventional training machine of the upstairs-type, the speed of the up-and-down motion of the crank pedals is controlled by a braking force generated by a field current of a rheostatic brake load means which varies in proportion to the up-and-down driving speed of the crank pedals. Thus, the braking force of the rheostatic brake load means is not controlled by taking into consideration the weight, exercise efficiency, age, sex, physical strength, etc., of the exerciser.

In the conventional training machine of the upstairs-type, return mechanisms for the right and left crank pedals are constituted respectively by separate right and left springs, and therefore the reaction forces exerted by the springs respectively on the right and left feet of the exerciser are different from each other. Therefore, proper simulation of climbing stairs cannot be obtained.

Accordingly, in the conventional training machine of the upstairs type, the load of the rheostatic brake load means can not be adjusted in accordance with the level of the physical strength of the individual exerciser and in accordance with variations in physical conditions during the training, so that it has been difficult to set an effective exercise load for the exerciser. As a result, there have been problems that the training is either excessive or not sufficiently challenging.

Further, in the conventional upstairs type training machine, the reaction forces of the crank pedals differ depending on the position of the specific exerciser and the positions of the right and left feet of the exerciser. Further, there has been a problem with the durability of the springs.

SUMMARY OF THE INVENTION

The present invention has been made in view of the above problems, and an object of the invention is to provide a step-type training machine and a method of controlling the same. In view of the correlation between an exercise load and a heart rate, a target heart rate is set beforehand. Further, in order to control the braking force of an eddy current load means so that the heart rate during the training can increase slowly toward the target heart rate in accordance with the rate of increase of the load suited for the exerciser, the driving speed of right and left crank pedals, driven up and down by the exerciser independently of each other, is controlled by the eddy current load means to control the exercise load experienced by the exerciser. The above training machine control method comprises the steps of determining the target heart rate in accordance with the heart rate, age, sex, etc., of the exerciser; continuously detecting the pulse of the exerciser and determining the exercise load so that the heart rate during the exercise coincides with the target heart rate determined in accordance with the age, sex, etc., of the exerciser; determining the target exercise load while measuring the physical strength condition of the exerciser so that the pulse can be brought into the target new rate range without exerting an excessive load on the exerciser (i.e., a warming-up step); and adjusting the amount of control of the exercise load in accordance with the level of the physical strength measured during the warming-up in the above pulse control so as to bring the heart rate into the optimum heart rate. A processing means is provided for processing the data obtained in the above steps, and the eddy current load means is controlled by a control signal extracted by the processing means.

The above training machine comprises a frame; a plate for mounting various parts at a lower portion of the frame; a pair of crankarms each pivotally mounted by a pivot shaft on the plate and having a step member mounted on its one end movable up and down through a predetermined angle; eddy current load means rotated by the swinging movement of the pair of crankarms; input means for inputting individual data of the exerciser; means for measuring the heart rate of the exerciser; rotation frequency detection means for detecting the rotation frequency of the eddy current load means; processing means for extracting a control signal in accordance with the data obtained by the above input means, the above heart rate measurement means and the above rotation frequency detection means, the control signal controlling the eddy current load means; and display means for displaying predetermined date extracted by the processing means.

With the above construction, the exercise load is set by the heart rate, and by feeding back the heart rate during exercise, the load of the eddy current load means is automatically controlled so that the exercise load can be maintained at a level suited for the level of the physical strength of an individual exerciser.

In the present invention, in order to solve the above problems, the cranks have an L-shape, and the steps are mounted respectively on one end of each of the L-shaped cranks. Power transmission mechanisms, such as chains, are respectively connected at one end thereof to the other ends of the cranks, and the other ends of the chains are connected together by a single spring.

With the above construction, when the reaction force of each crank pedal is measured with the spring removed, the load acting on the power transmission mechanism such as a chain decreases as the crank pedal goes up, and increases as the crank pedal goes down, depending on the position of the center of gravity of the L-shaped crankarm. The reaction force of the spring connected to the other end of the chain and the variation of the above load cancel each other, so that the reaction force of the pedal is kept substantially constant.

The right and left crank pedals are interconnected by the single spring, and therefore during the exercise in which the crank pedals move up and down alternately, the tension of the spring is :maintained generally constant, and as a result the durability of the spring is enhanced.

The present invention is constructed by a frame portion A, crank pedal portions B, a drive portion C and a control portion D. The driving speed of the crank pedal portions B, driven up and down by the right and left feet of the exerciser. independently of each other, is adjusted by the drive portion C, and the exercise load exerted on the exerciser is controlled by the control portion D.

With the above construction, the crankarms to which the steps are secured can be shortened, so that the overall construction of the crank pedal portions B can be compact. The drive portion C for controlling the driving speed of the crank pedal portions B, are received as a unit within a center frame mounted on a base frame, and therefore the compact construction can also be achieved in this respect, as compared with the conventional step-type training machine. Further, the right and left steps are interconnected by the single spring, and therefore the load exerted by the upward and downward movement of the arms can be reduced, and the upward and downward movement of the arms can be performed more smoothly.

BRIEF DESCRIPTION OF THE DRAWINGS

FIGS. 1(*b*) to 1(*e*) are a plan view, a side-elevational view, a perspective view and a partly-broken, perspective view of the training machine, respectively;

FIGS. 4-1 and 4-2 are a flow charts for a step-type training machine control method according to the present invention;

DESCRIPTION OF THE PREFERRED EMBODIMENTS

A step-type training machine and a method of controlling the same, provided in accordance with the present invention, will now be described in detail with reference to FIGS. 1 to 6.

Figures 1, 4:
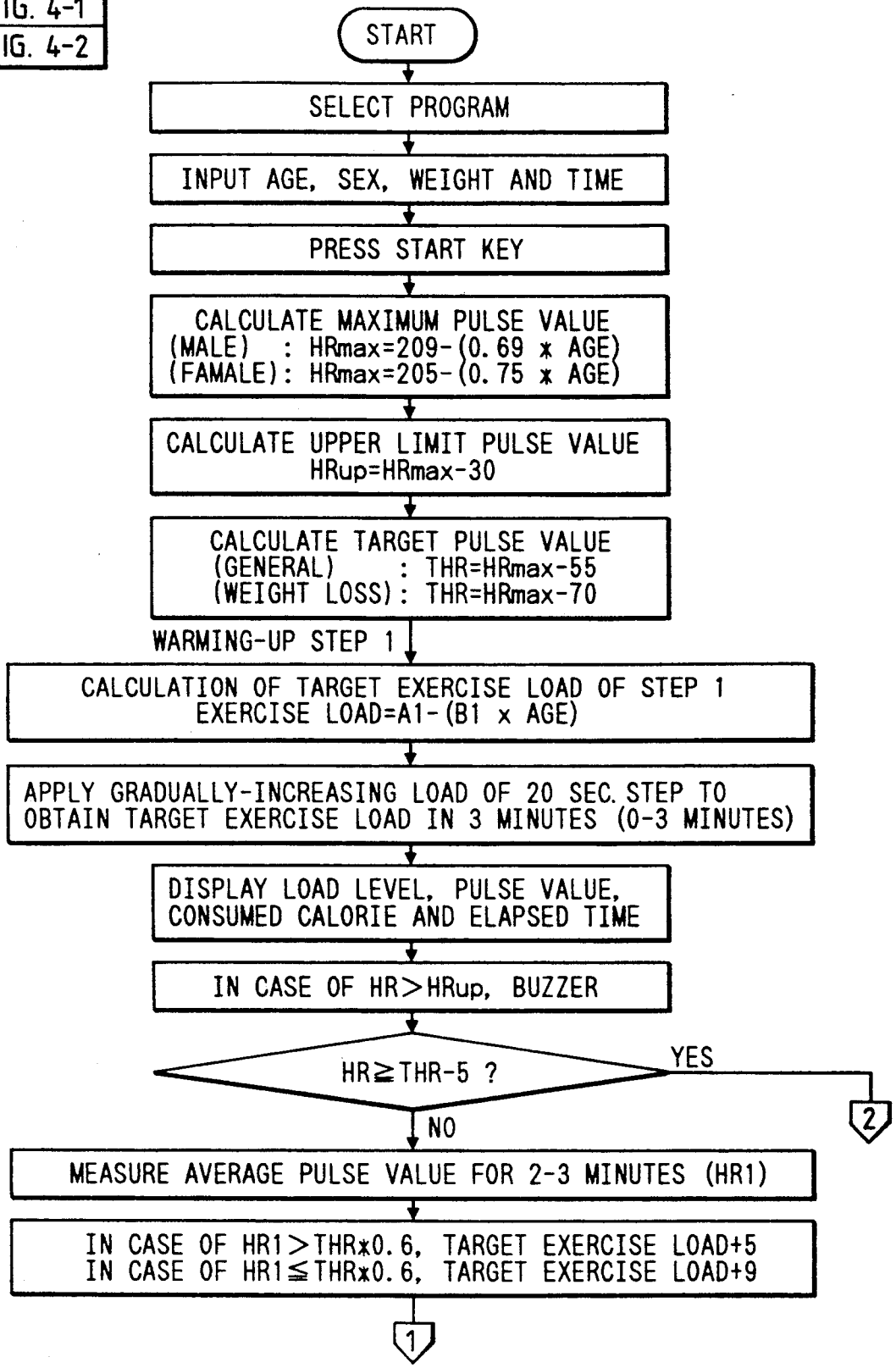
Figures 2, 4:
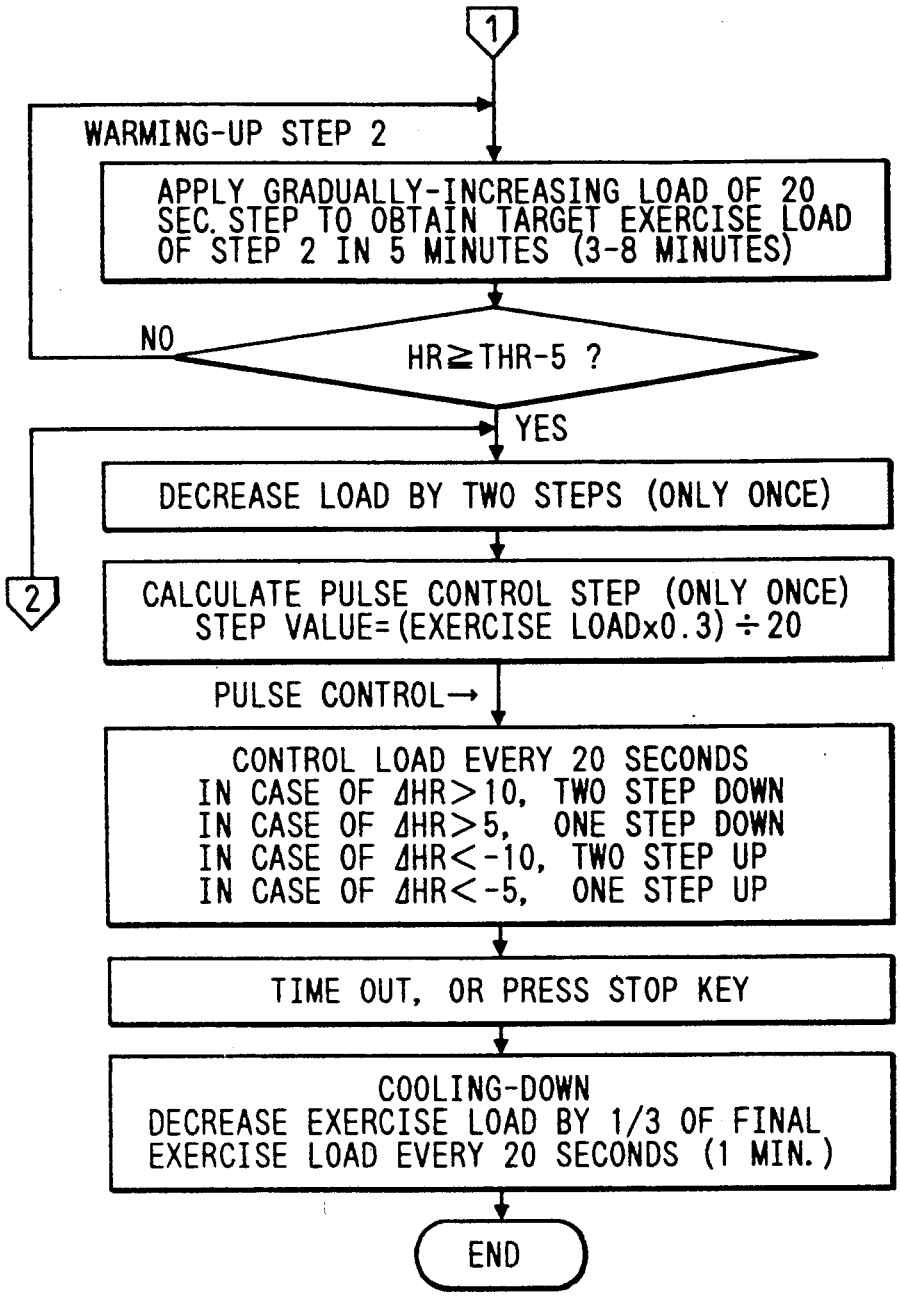

FIG. 1(*a*) is a perspective view showing the overall construction of a step-type training machine using the control method of the present invention. Referring thereto, the machine includes a frame portion A, a crank pedal portion B, a drive portion C, and a control portion D. The frame portion A is constituted in the following manner. A pair of L-shaped pipes 1*a* respectively include legs disposed horizontally and parallel to each other, which are interconnected by a pair of under plates 1*b*. A base plate 1*c* is mounted on the under plates 1*b* and 1*b* with a separator (not shown) to provide a space S therebetween. Opposite ends of a U-shaped upper pipe 1*d* having a width separating the two parallel legs equal to the distance between the under pipes 1*a* and 1*a* are connected respectively to the vertically-directed upper ends of the under pipes 1*a* and 1*a* through collar joints 1*e* and 1*e*.

The crank pedal portion B includes a pair of L-shaped crankarms 2*a*, 2*a* which are pivotally secured to pivot shaft 2*b*. Specifically, pivot shaft 2*b* extends through corner portions of the crankarms 2*a*, 2*a* and the end portions of the pivot shaft 2*b* are respectively secured by pivot bearings 2*c* and 2*c* mounted on the central, rear portion of the rear under plate 1*b* extending between the under pipes 1*a* and 1*a*. The two pivot bearings extend vertically and are spaced a predetermined distance from each other. Pedals 2*d*, 2*d* are pivotally mounted respectively on the rear ends of the two crankarms 2*a*, 2*a*. Parallel links 2*e* and 2*e* each extend from a position slightly displaced from the position of pivotal mounting of the pedal 2*d* on the crankarm 2*a* to a position slightly displaced from the pivot shaft 2*b*. Therefore, the angular movement of the two pedals 2*d* and 2*d* is not influenced by the angle of up-and-down movement of the crankarms 2*a* and 2*a*, so that the pedals can be always kept horizontal.

As best shown in FIG. 1(*c*), and as discussed above, each of the right and left crank arms 2*a* and 2*a* is formed in an L-shape. A reaction force T, acting on the pedal 2*d* through the crankarm 2*a* when a spring (later described) is removed, is the difference between the distance B (between a front point F of the center of gravity of the L-shaped crankarm 2*a* and the pivot shaft 2*b*)×a front load L and the distance A (between a rear point R center of gravity and the pivot shaft 2*b*)×a rear load K.

$$T=(B\times L)-(A\times K)$$

Therefore, the load (reaction force T) acting on a power transmission mechanism (e.g. chain) decreases as the position of the pedal 2*d* goes higher, and also increases as the position of the pedal goes lower. Namely, the reaction force of the spring connected to the other end of the chain and the variation of the above load cancel each other, so that the reaction force T of the pedal is maintained constant.

The drive portion C comprises a drive shaft 3*c* supported by bearings 3*a* and 3*a* mounted respectively on the right and left portions of the base plate 1*c*, a pair of right and left free wheels 3*b* and 3*b* mounted on the drive shaft 3*c*, a speed increaser 3*d* mounted on one side portion of the front portion of the base plate 1*c*, and an eddy current load means 3*e* disposed on one side of the speed increaser 3*d*. In order to drive the free wheels 3*b* and 3*b*, the speed increaser 3*d* and the eddy current load means 3*e*, chains 3*f* and 3*f*, which are connected to the front ends of the crankarms 2*a* and 2*a*, transmit the up-and-down motion of the two crankarms 2*a* and 2*a* to drive sprockets 3*g* and 3*g* mounted on the central portion of the drive shaft 3*c* and spaced a predetermined distance from each other. The rotation of the drive sprockets 3g and 3g is converted by the free wheels 3b and 3b into rotation in one direction, and is transmitted to the drive shaft 3c. The rotation of the drive shaft 3c is then transmitted to the speed increaser 3d through a chain 3j circumscribing a sprocket 3h mounted on the drive shaft 3c and a sprocket 3i mounted on an input shaft of the speed increaser 3d. The output increased rotational speed of the speed increaser 3d is transmitted to the eddy current load means 3e through a timing belt 3m circumscribing a timing pulley 3k mounted on an output shaft of the speed increaser 3d and a timing pulley 3l mounted on an input shaft of the eddy current load means 3e.

The chains 3f and 3f connected respectively to the front ends of the two crankarms 2a and 2a are extended respectively around the drive sprockets 3h and respectively around a pair of right and left sprockets 3n and 3n mounted on the base plate 1c and spaced a predetermined distance from each other. The chains are then passed through the space S formed between the base plate 1c and the under plates 1b and 1b, and are connected respectively to the opposite ends of a single spring 3r. The spring 3r is extended around pulleys 3p and 3p mounted on the central, front portion of the plate 1b and spaced a predetermined distance from each other, and is extended around pulleys 3q and 3q provided at the central, rear portion of the plate and spaced a predetermined distance from each other. With this arrangement, the chains 3f and 3f can be moved smoothly.

The control portion D comprises a processing means (hereinafter referred to as "microcomputer") 4b, a pulse detection circuit 4c and an alarm buzzer 4d contained in a box 4a mounted on the central portion of the upper end of the U-shaped upper pipe 1d. Further, the control portion includes a display portion 4e (which displays, for example, the pulse value, the load level, the age, sex, the weight, the time, the elapsed time, the calories consumed, the kind of training, and so on) mounted on the upper surface of the box 4a, input keys 4f for inputting various data, a rotation frequency detector 4g for the eddy current load means 3e which detector is disposed outside of the box 4a and is connected via lead wires to the microcomputer 4b and the pulse detection circuit 4c, a pulse sensor 4h, a constant current power source 4i, and an interface circuit 4j.

The above data can be printed out by a printer 4k connected via the interface circuit 4j. This machine may have a communication function by which the machine is connected to an external host computer via this interface circuit so that data can be inputted from the exterior, instead of inputting the data by the input keys 4f, and also the data representative of the results of the training can be outputted.

The operation of the step-type training machine of the present invention, as well as a method of controlling this training machine, will now be described with reference to the above construction.

Figure 1A:
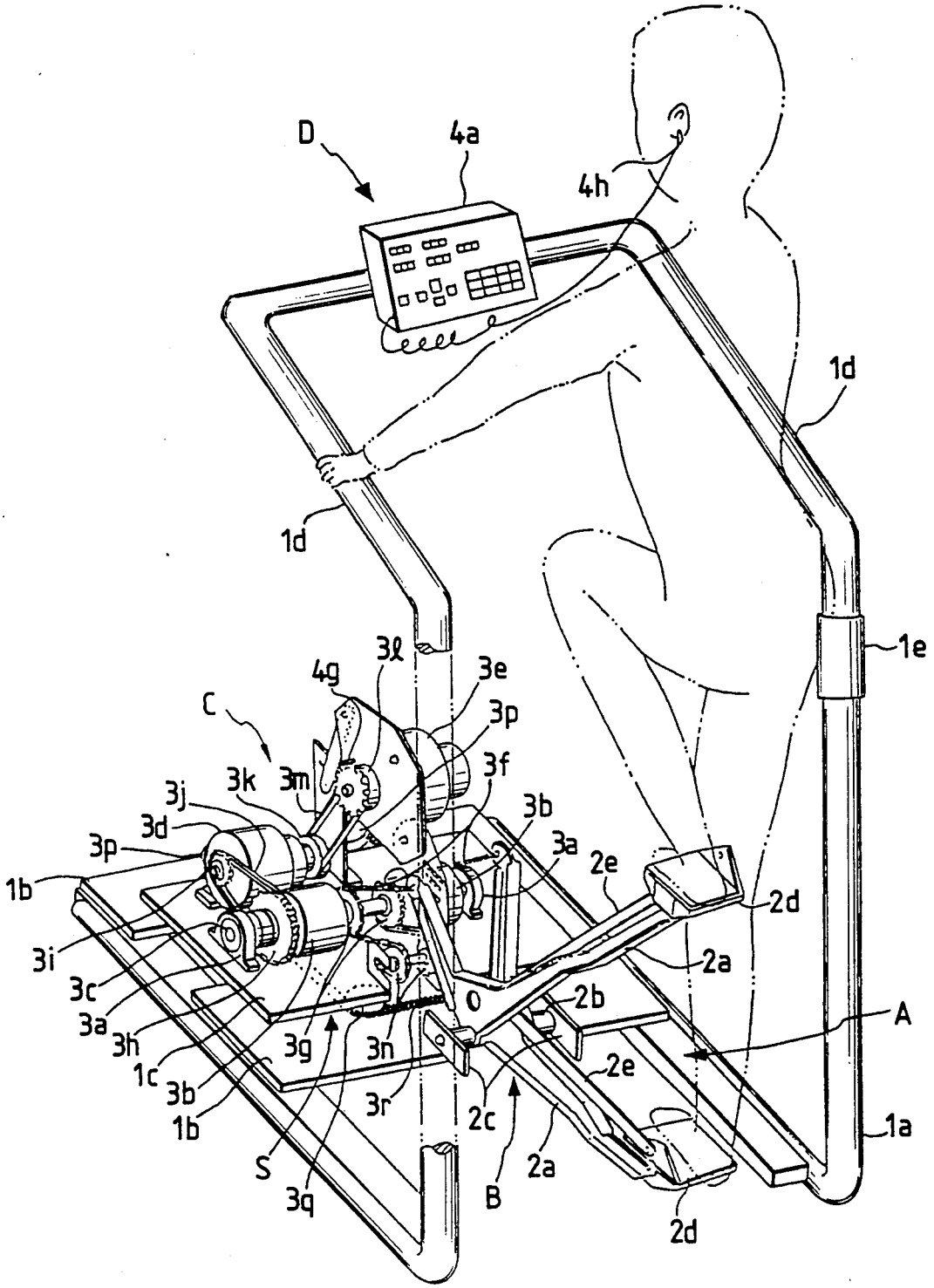
FIG. 1(*a*) is a perspective view showing the overall construction of a first embodiment of a step-type training machine of the present invention.
Figure 1B:
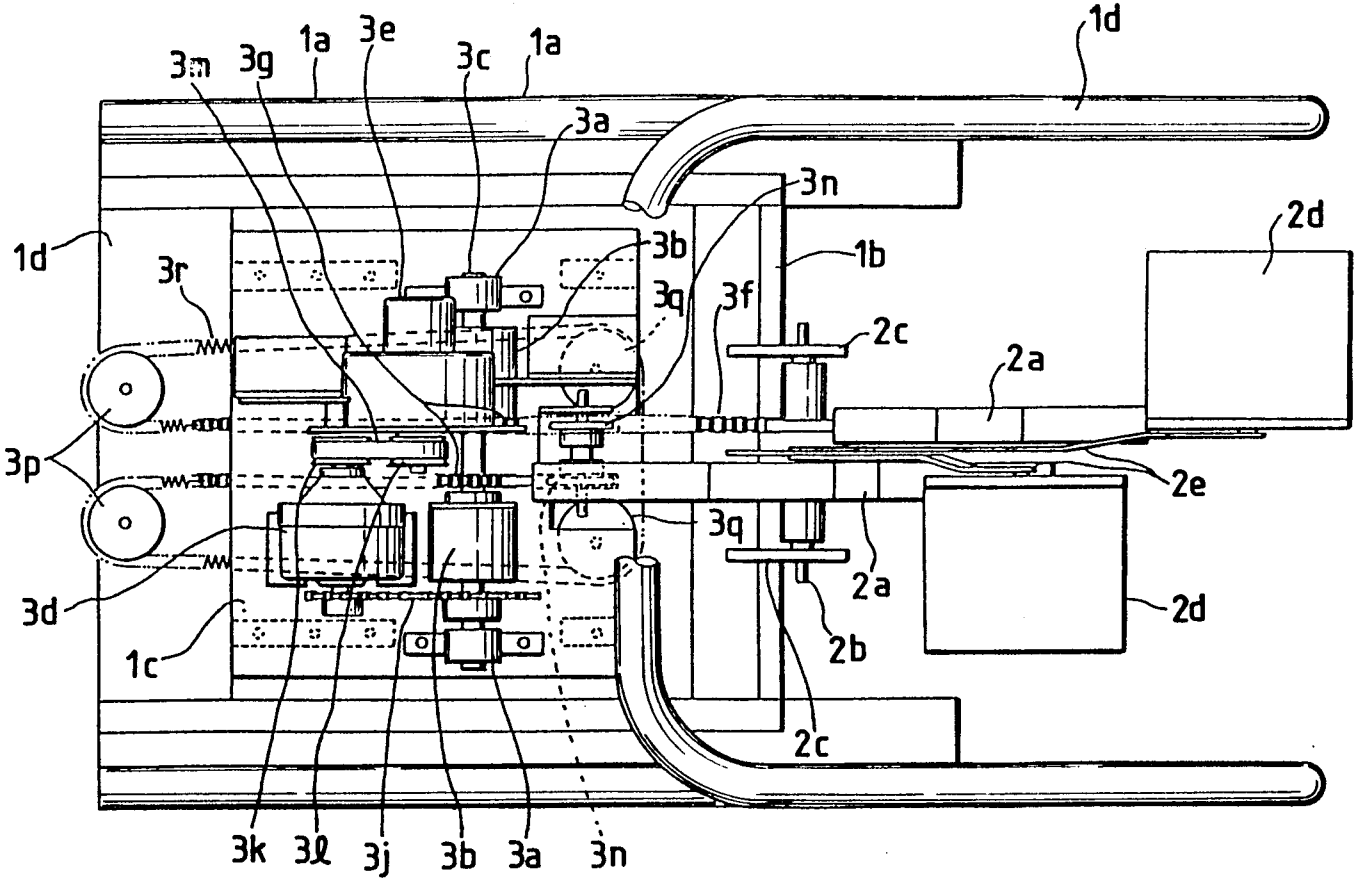
Figure 1C:
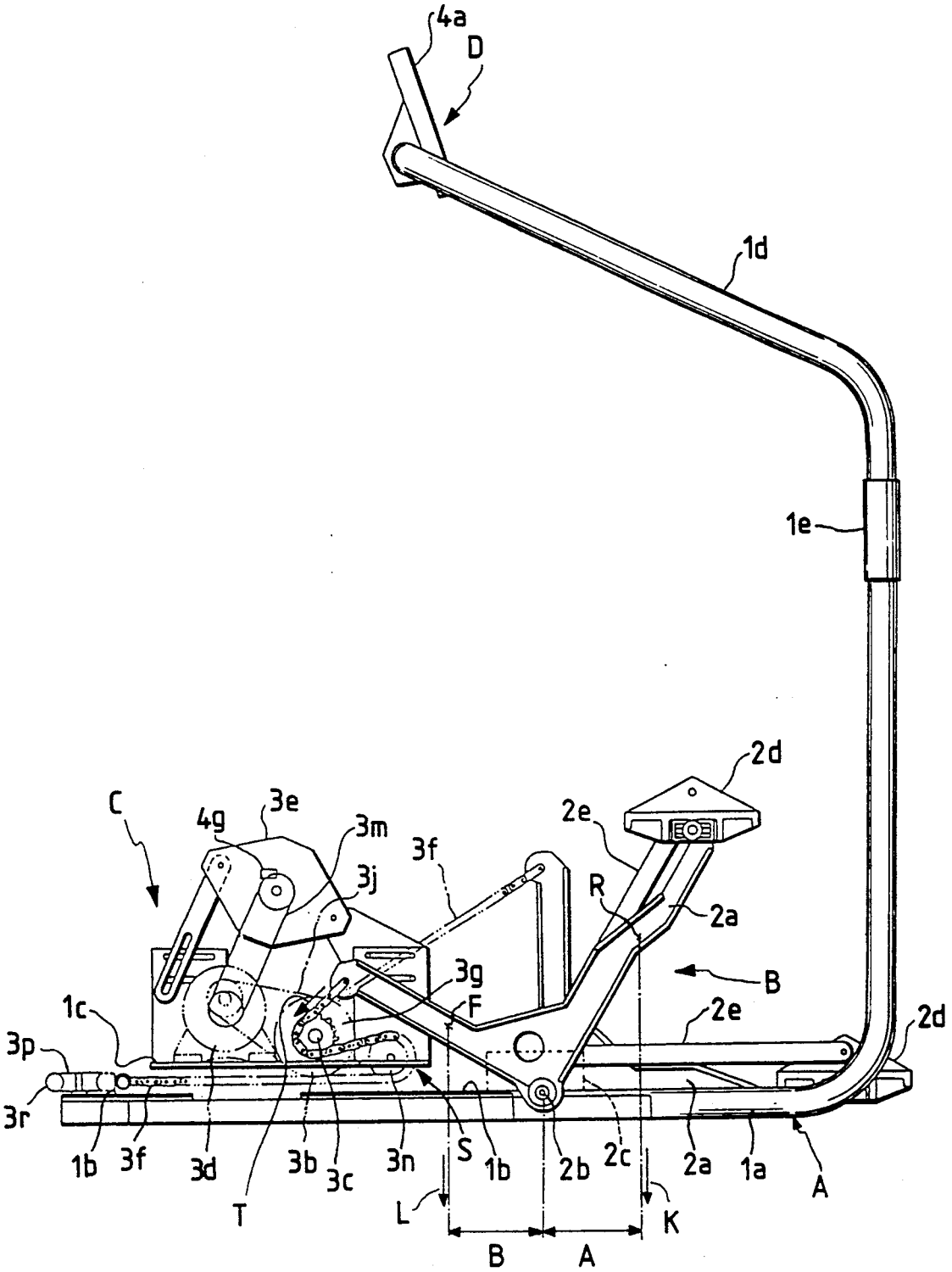
Figure 1D:
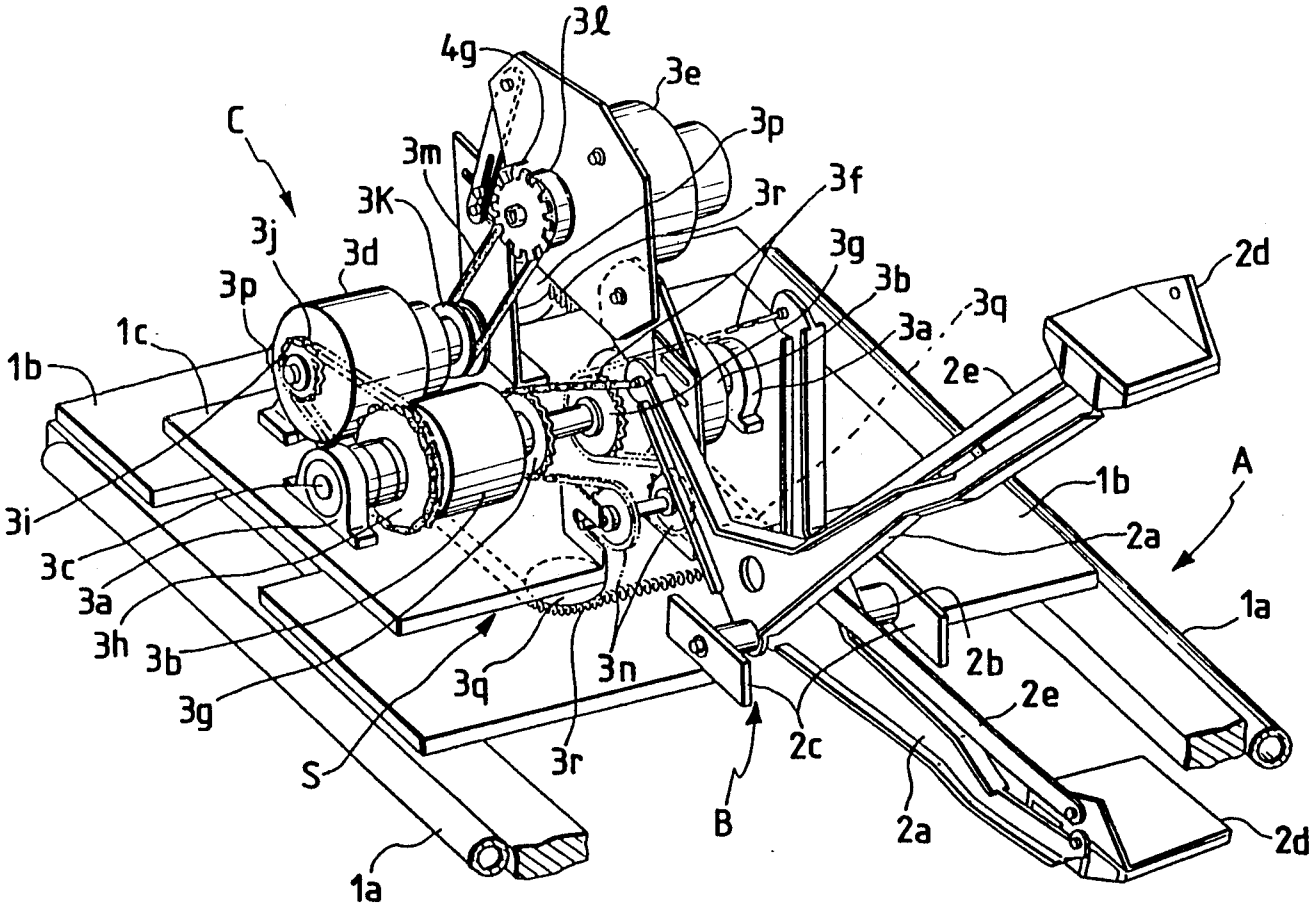
Figure 1E:
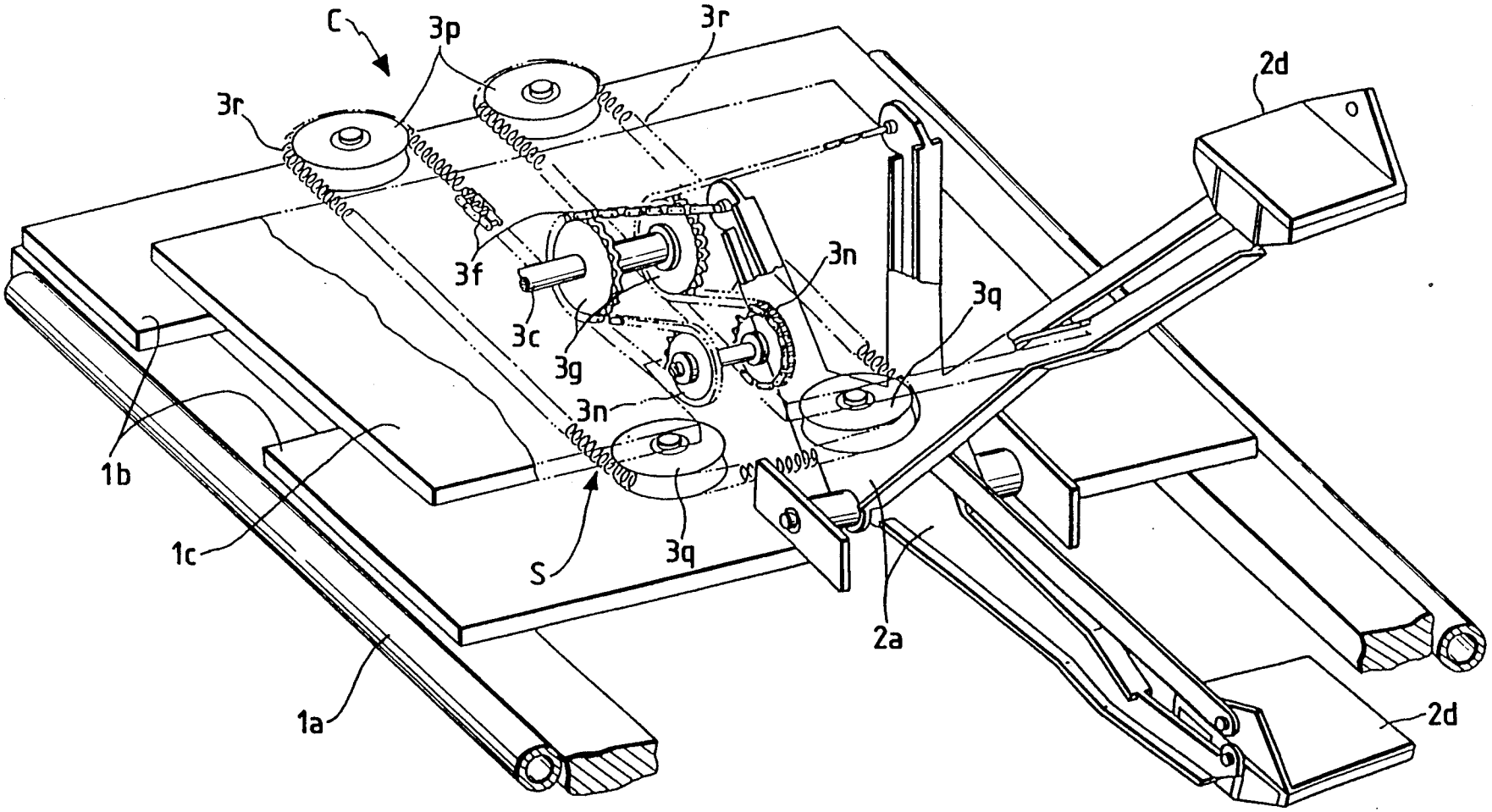
Figure 2:
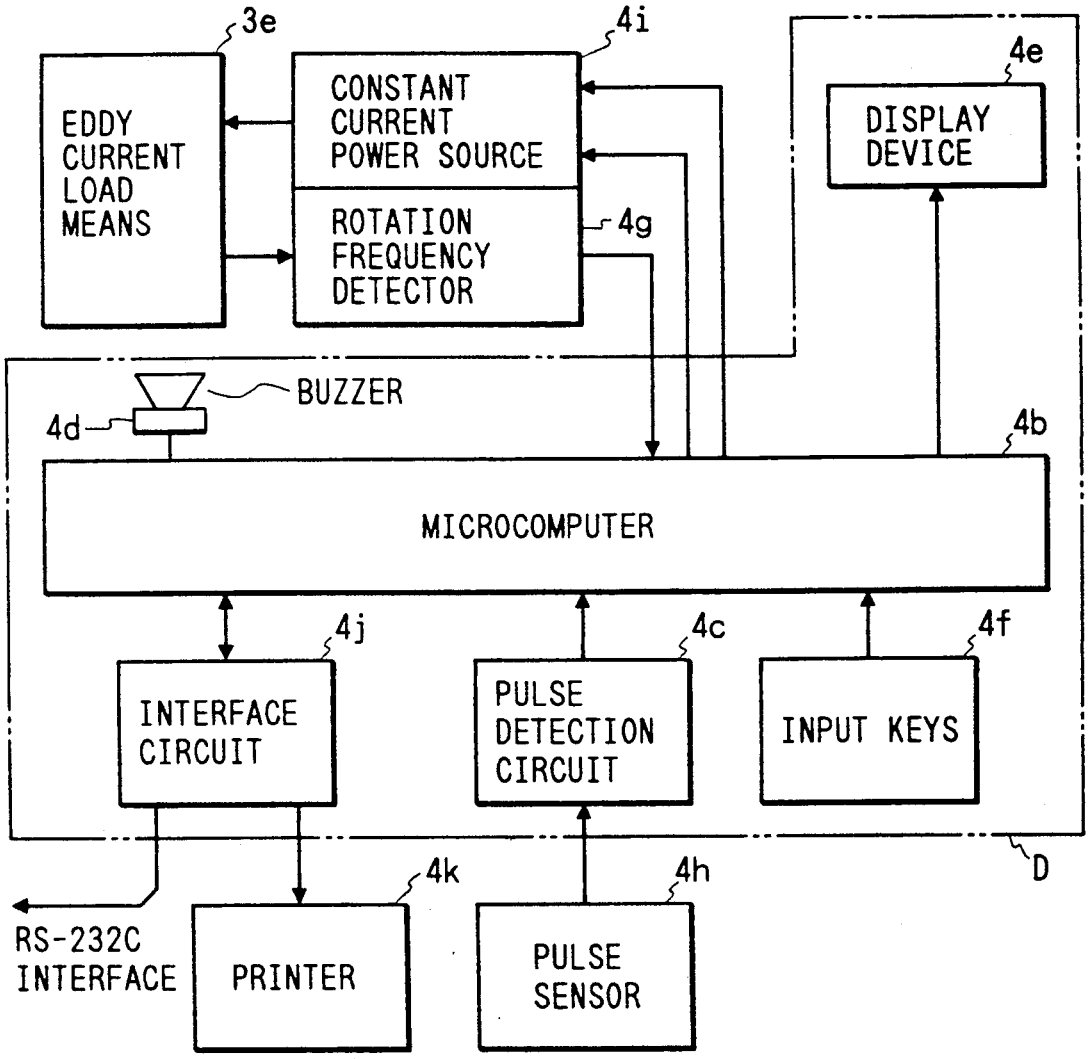
FIG. 2 is a block diagram of a control portion of the training machine.
Figure 3:
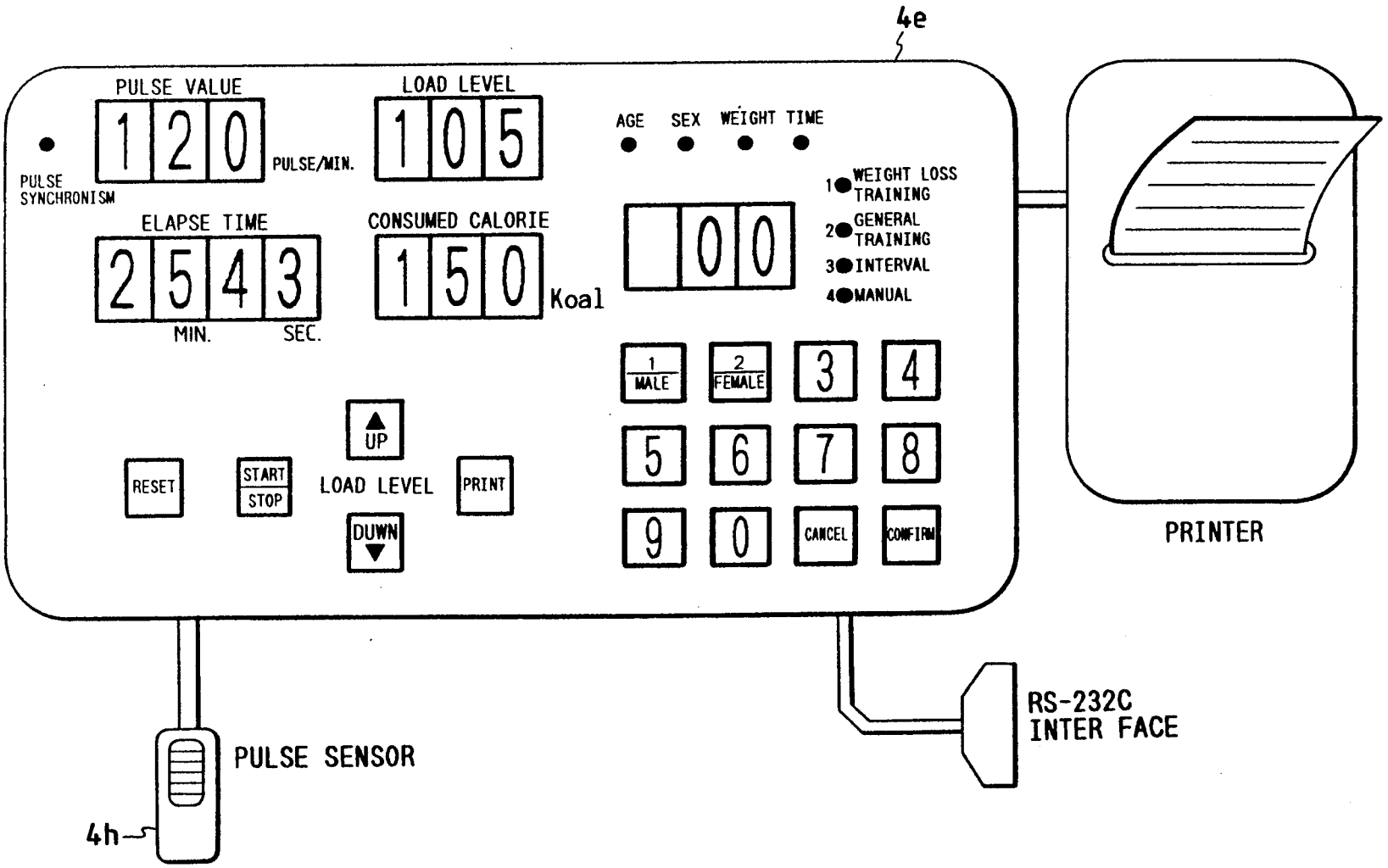
FIG. 3 is a view showing a panel of the training machine.

First, the operation of the step-type training machine will be described. As shown in FIG. 1(a), the exerciser M places both feet on the pedals 2d and 2d, and presses down the right and left crankarms 2a and 2a alternately with the right and left feet. By this stepping operation, the right and left crankarms 2a and 2a are angularly moved about the respective pivot shafts 2b and 2b through a predetermined angle.

For example, when the left crankarm 2a shown in solid lines in FIG. 1(a) is pressed down by the left foot of the exerciser M, the front end of the left crankarm (to which the chain 3f is connected) disposed forwardly of the pivot shaft 2b is angularly moved rearwardly along an arcuate path from its lower position shown in FIG. 1(a). Therefore, the left chain 3f connected to the front end of this crankarm 2a is pulled rearwardly. As a result, the drive sprocket 3g, around which the chain 3f is disposed, is rotated, and this rotation is transmitted to the left free wheel 3b which is integral with the drive sprocket 3g so that the drive shaft 3c extending through this free wheel 3b is rotated in one direction. The rotation of the drive shaft 3c is transmitted to the speed increaser 3d via the chain 3j disposed around the sprocket 3h, fixedly mounted on the left end portion of the drive shaft 3c, and the sprocket 3i mounted on the input shaft of the speed increaser 3d. The rotation thus inputted to the speed increaser 3d is increased to a preset rotation frequency, and is transmitted to the eddy current load means 3e via the timing belt 3m disposed around the timing pulley 3k, mounted on the output shaft of the speed increaser, and the timing pulley 3l mounted on the input shaft of the eddy current load means 3e, thereby rotating the eddy current load means 3e.

The end of the left chain 3f is connected to the right chain 3f via the spring 3r, and therefore the movement of the left chain 3f is transmitted to the right chain 3f via the spring 3r. The right chain 3f, previously pulled rearwardly by the front end of the right crankarm 2a as shown in solid lines in FIG. 1(a), is returned by the rearward movement of the left chain 3f, so that the front end of the right crankarm 2a is moved forwardly. Namely, when the left crankarm 2a is pressed downwardly by the left foot of the exerciser M, the exerciser M is simultaneously raising the right foot by ordinary stepping action, and therefore the load of the right crankarm 2a pulled by the right chain 3f is reduced, so that the pedal 2d of the right crankarm 2a is smoothly moved upward. The tension of the spring 3r applying a predetermined tension to the right and left crankarms 2a and 2a is kept generally constant, and therefore the durability of the spring 3r is enhanced.

When the down stroke of the left foot of the exerciser M is started, the pedal 2d pivotally connected to the right crankarm 2a is moved upward, and the exerciser M lowers the right foot.

When the exerciser M presses down the right crankarm 2a using the right foot, the front end of this crankarm (to which the chain 3f is connected) disposed forwardly of the pivot shaft 2b of the right crankarm 2a is angularly moved rearwardly along an arcuate path. As a result, the right chain 3f connected to the front end of the right crankarm 2a is pulled rearwardly. Accordingly, the drive sprocket 3g, around which this chain 3f is disposed, is rotated, and this rotation is transmitted to the right front wheel 3b which is integral with this drive sprocket 3g, so that the drive shaft 3c extended through the free wheel 3b is rotated in one direction. The rotation of the drive shaft 3c is inputted to the speed increaser 3d via the chain 3j disposed around the sprocket 3h, fixedly mounted on the left portion of the drive shaft 3c, and the sprocket 3i mounted on the input shaft of the speed increaser 3d. The rotation inputted to the speed increaser 3d is increased to a predetermined rotation frequency, and is transmitted to the eddy current load means 3e via the timing belt 3m disposed around the timing pulley 3*k*, mounted on the output shaft of the speed increaser, and the timing pulley 3*l*, mounted on the input shaft of the eddy current load means 3*e*, thereby rotating the eddy current load means 3*e*.

The end of the right chain 3*f* pulled by the pressing-down the right crankarm 2*a* is connected to the left chain 3*f* via the spring 3*r*, and therefore the movement of the right chain 3*f* is transmitted to the left chain 3*f* via the spring 3*r*. Accordingly, the right chain 3*f* is in a pulled condition as a result of the rearward angular movement of the front end of the right crankarm 2*a*, and the left chain 3*f* connected to the right chain 3*f* via the spring 3*r* is moved forwardly. Namely, in the step-type training machine of the present invention, the exerciser M performs the exercise for a predetermined time period in which the exerciser presses down the right and left crankarms 2*a* and 2*a* alternately by the right and left feet as in climbing stairs. During this exercise, the load of the eddy current load means 3*e* is controlled by a control method, described below to maintain the optimum level suited for the exerciser.

A second preferred embodiment of a step-type training machine of the present invention will now be described with reference to FIGS. 7 and 8.

Figure 7:
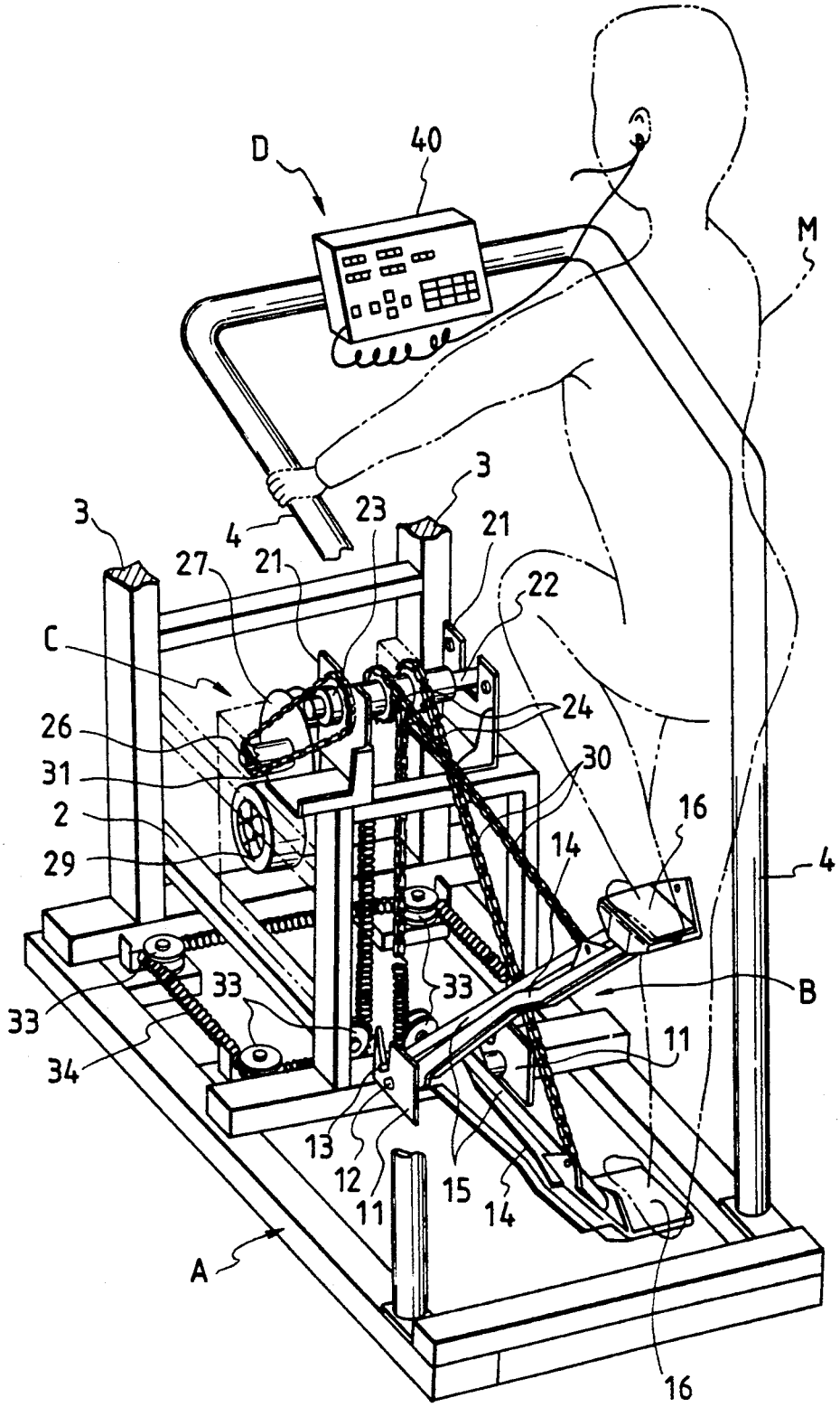
FIG. 7 is a perspective view of an overall construction of a second embodiment of a step-type training machine of the present invention.
Figure 8:
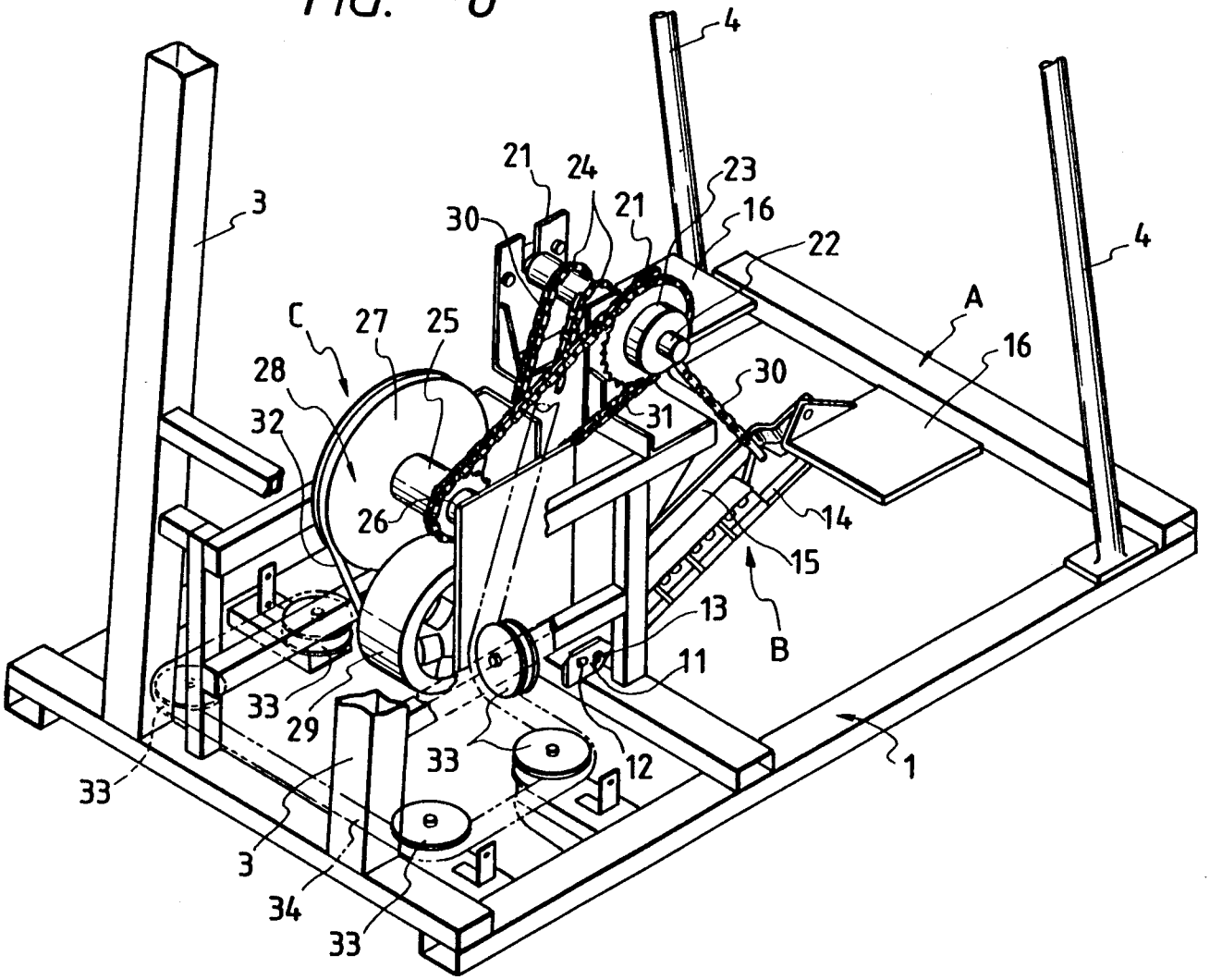
FIG. 8 is a plan view of a portion of the training machine of FIG. 7.

FIG. 7 is a perspective view showing the overall construction of the step-type training machine of the present invention, and FIG. 8 is a perspective view of the drive portion thereof.

The overall structure of the present invention comprises a frame portion A, a crank pedal portion B, a drive portion C including a crank pedal return mechanism, and a control portion D.

Details of each of the above portions will be described as follows. The frame portion A comprises a base frame 1 of a generally square shape, a center frame 2 of a generally cubic-skeleton shape mounted on the base frame 1, vertical posts 3 mounted on the front portion of the base frame 1 and spaced a predetermined distance from each other, and side guards 4 generally vertically mounted on the rear portion of the base frame 1 and spaced a predetermined distance from each other, the side guards 4 being bent toward the posts 3 and connected at their front ends to the upper ends of the posts 3.

The crank pedal portion B comprises brackets 11 mounted on a generally central portion of the base frame 1 and spaced a predetermined distance from each other, a pivot shaft 12 and a link shaft 13 which are parallel to each other and supported by the brackets 11, a pair of right and left arms 14 pivotally mounted at one ends thereof on the pivot shaft 12 so as to be pivotally movable vertically, a pair of right and left links 15 pivotally mounted at one ends thereof on the link shaft 13 so as to be pivotally moved vertically, and right and left steps 16 pivotally mounted respectively on the distal ends of the right arm 14 and link 15 and the distal ends of the left arm 14 and link 15 so that the upper surfaces of the steps 16 can always be maintained generally horizontal.

The drive portion C comprises a drive shaft 22 supported by a pair of upstanding bearings 21 mounted on the center frame 2 (which is mounted on the front portion of the base frame 1) and spaced a predetermined distance from each other, a sprocket 23 fixedly mounted on one end portion of the drive shaft 22, a pair of right and left free wheel sprockets 24 mounted on the drive shaft 22, a speed increaser 28 which is mounted within the center frame 2 (the speed increaser 28 is inserted into the center frame 2 from the front of this center frame) and includes a rotation shaft 25, a sprocket 26 mounted on one end portion of the rotation shaft 25 and a pulley 27 of a large diameter mounted on the other end portion of the rotation shaft 25, and an eddy current load means 29 mounted below the speed increaser 28. The free wheel sprockets 24, the speed increaser 28 and the eddy current load means 29 are driven as follows. The chains 30 (that is, the movements of the two chains 30 in response to the upward and downward swinging movement of the two arms 14), are connected at their one ends respectively to the right and left arms 14 adjacent to the steps 16. Upward and downward movement of the two arms is transmitted through the chains to the free wheel sprockets 24 mounted on the drive shaft 22. The rotation of the drive shaft 22 is transmitted to the large pulley 27 via a chain 31 disposed around the sprocket 23, mounted on the drive shaft 22, and the sprocket 26, mounted on the rotation shaft 25 of the speed increaser 28. The rotation increased by the large pulley 27 is transmitted to a timing pulley (not shown), mounted on an input shaft of the eddy current load means 29, via a timing belt 32 extended around the large pulley 27, thereby driving the eddy current load means 29.

The right and left chains 30, connected at their one ends respectively to the two arms 14, are connected at the other ends thereof to opposite ends of a single spring 34, respectively, via the right and left free wheel sprockets 24 mounted on the drive shaft 22. The spring 34 is disposed around six pulleys 33. More specifically, one pair of the six pulleys 33 are provided at the central portion of the base frame 1, another pair of pulleys 33 are provided on the opposite sides of this central portion, and the final pair of pulleys 33 are provided respectively at the right and left sides of the front portion of the base frame 1. With this arrangement, the chains 30 can be moved smoothly in response to the upward and downward movement of the right and left arms 14.

The control portion D comprises a processing means (hereinafter referred to as "microcomputer") 4*b*, a pulse detection circuit 4*c*, an alarm buzzer 4*d* contained in a box 40 mounted on the generally central portion of the U-shaped upper portion of the side guard 4. Additionally, the control portion D includes a display portion 4*e* (which displays, for example, the pulse value, the load level, the age, sex, the weight, the time, the elapsed time, the calories consumed, the kind of training, and so on) mounted on the upper surface of the box 4*a*, input keys 4*f* for inputting data, a rotation frequency detector 4*g* for the eddy current load means 29 which detector is disposed outside of the box 40 and is connected via lead wires to the microcomputer 4*b* and the pulse detection circuit 4*c*, a pulse sensor 4*h*, a constant current power source 4*i*, and an interface circuit 4*j*.

The above data can be printed out by a printer 4*k* connected via the interface circuit 4*j*. This machine may be connected to an external host computer via this interface circuit 4*j* so that the data (e.g. the load level, the age, sex, the weight, the time, the elapsed time, the calories consumed, the kind of training, and so on) can be inputted from the outside, instead of inputting the data by the input keys 4*f*. Additionally, the data representative of the results of the training can be outputted through the computer.

The operation of the step-type training machine of the above construction according to the present invention will now be described.

First, the operation of the step-type training machine will be described.

As shown in FIG. 7, the exerciser M places both feet on the right and left steps 16 and 16, and presses down the right and left arms 14 and 14 alternately with the right and left feet. By this stepping operation, the right and left arms 14 and 14 are angularly moved about the pivot shaft 12 through a predetermined angle.

For example, when the left arm 14 shown in a solid line in FIG. 7 is pressed down by the left foot of the exerciser M, the chain 30, connected to that portion of the left arm 14 disposed forward of the step 16, is pulled down in response to the downward movement of the left arm 14.

Therefore, the free wheel sprocket 24, around which this chain 30 is disposed, is rotated, causing the drive shaft 22 (on which this free wheel sprocket 24 is mounted) to rotate in one direction. The rotation of the drive shaft 22 is inputted to the large pulley 27 via the chain 31 disposed around the sprocket 23, fixedly mounted on the drive shaft 22, and the sprocket 26, mounted on the rotation shaft 25 of the large pulley 27. The rotation inputted to the large pulley 27 is increased to a predetermined rotation frequency, and is transmitted to the timing pulley and finally to the eddy current load means 29 via the timing belt 32 disposed around the large pulley 27, thereby rotating the eddy current load means 29.

The end of the left chain 30, pulled by the pressing-down of the left arm 14, is connected to the right chain 30 via the spring 34. The right chain 30 is pulled rearwardly by the right arm 14 as shown in solid lines in FIG. 7. In this condition, the spring 34 is moved to the left in response to the downward movement of the left chain 30, and as a result the right arm 14 angularly moved rearwardly tends to move upward. Namely, when the left arm 14 is pressed down by the left foot of the exerciser M, the exerciser M raises the right foot by ordinary stepping action, and when the right step 16 is no longer pushed downwardly by the right foot, the right arm 14 pulled by the right chain 30 is smoothly moved upward. The tension of the spring 34 applied to the right and left arms 14 is kept generally constant, and therefore the durability of the spring 34 is enhanced.

When the left foot of the exerciser M is pressed down, the step 16, pivotally connected to the right arm 14, moves upward, and then the exerciser M raises the right foot.

When the exerciser M applies the load to the right step 16 by the right foot to press down the right arm 14, the chain 30 connected to that portion of the right arm 14 disposed forwardly of the step 16 is moved downward, and the free wheel sprocket 24 around which this chain 30 is disposed, is rotated, causing the drive shaft 22 (on which this free wheel sprocket 24 is mounted) to rotate in one direction. As described above for the pressing-down of the left step 16, the rotation of the drive shaft 22 is inputted to the large pulley 27 via the chain 31 around the sprocket 23, fixedly mounted on the drive shaft 22, and the sprocket 26 mounted on the rotation shaft 25 of the large pulley 27. The rotation inputted to the large pulley 27 is increased to the predetermined rotation frequency, and is transmitted to the timing pulley and finally to the eddy current load means 29 via the timing belt 32 around the large pulley 27, thereby rotating the eddy current load means 29. The end of the right chain 30 pulled by pressing down the right arm 14 is connected to the left chain 30 via the spring 34, and therefore the movement of the right chain 30 is transmitted to the left chain via the spring 34. The left chain 30 is pulled down by the downward movement of the left step 16, and as described above, the spring 34 is moved to the left in response to the downward movement of the right chain 30, so that this spring pulls the left chain 30. As a result, the left arm 14 tends to move upward. Namely, when the right step 16 is pressed down by the right foot of the exerciser M, the exerciser M raises the left foot by the ordinary stepping action, and when the left foot no longer presses down on the step 16, the left arm 14 pulled by the left chain 30 is smoothly moved upward.

Namely, in the step-type training machine of the present invention, the exerciser M performs the exercise for a predetermined time period in which the exerciser presses down the right and left steps 16 and 16 alternately by the right and left feet as in climbing stairs. Further, the load of the eddy current load means 29 is controlled by the control method described below to the optimum level suited for the exerciser M.

The method of controlling the eddy current load means **3*e*** will now be described in detail.

(1) First, the exerciser M connects the pulse sensor **4*h* to a suitable portion of the body, such as the earlobe, which enables the measurement of the pulse without interfering with the training. Then, the exerciser M inputs individual data (e.g. age, sex, weight, time period of exercise, and so on) by the input keys 4*f* of the display device 4*e*** shown in FIG. 3, while confirming this inputting operation by the display portion.

Then, the exerciser M holds the handrail portions, constituted by the upper pipes **1*d* and 1*d* of the frame portion A, to maintain balance, pushes a start/stop key on the display device 4*e*, and presses down the right and left pedals 2*d* and 2*d*** to start the training.

During the exercise, the heart rate, the load level, the amount of calories burned and the time elapsed from the start of the exercise are displayed in real time on the display portion.

Figure 5:
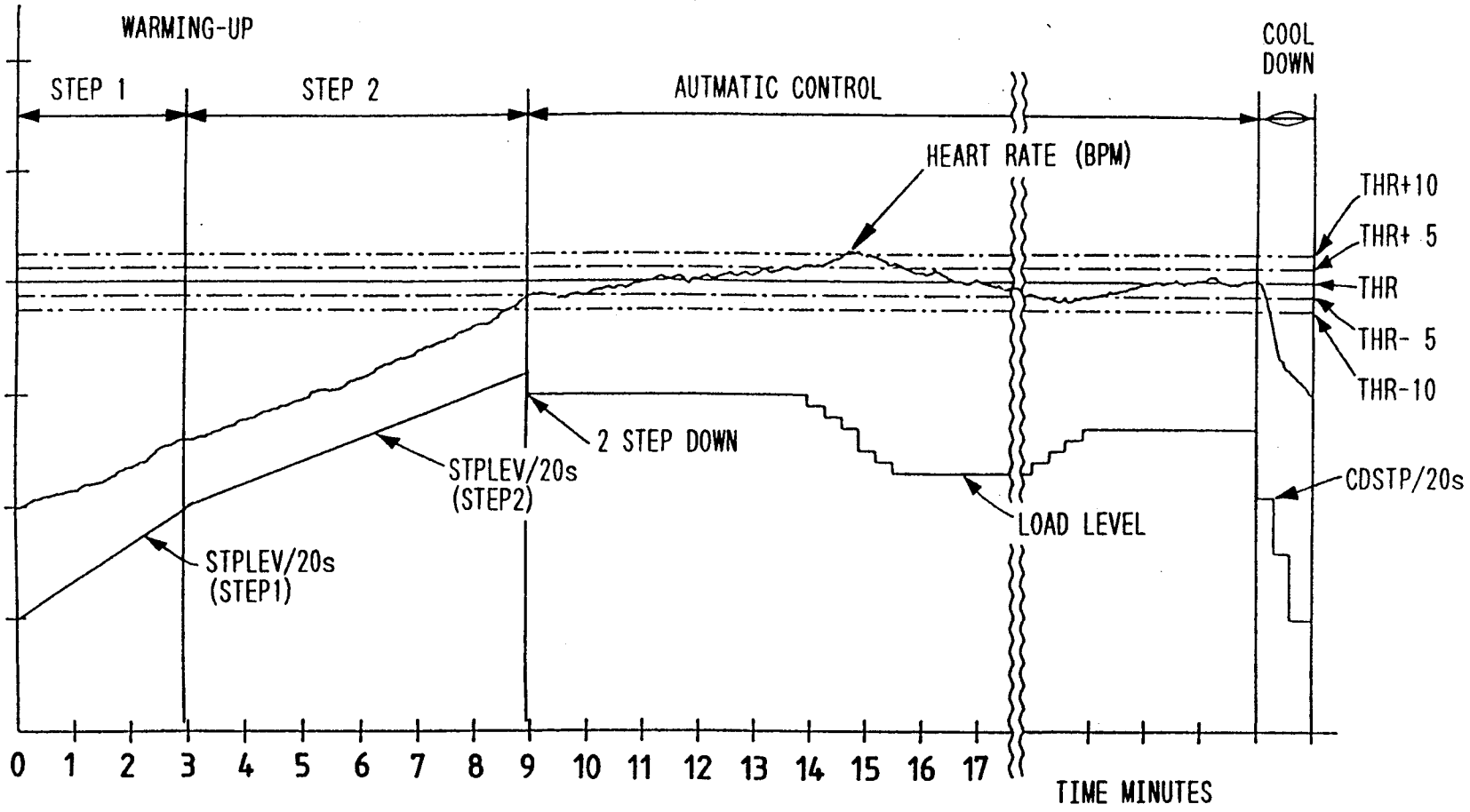
FIG. 5 is a graph showing the condition of setting the exercise loads for the training machine.

(2) In accordance with the individual data inputted at the above item (1), the microcomputer **4*b*** calculates the maximum heart rate, the upper limit heart rate, the target heart rate (an ordinary training or a training for losing weight), and so on, as shown in FIG. 5.

Based on the inputted age and sex, the maximum pulse value is determined by the following formula:

$$\text{(Male) } HRmax = 209 - (0.69 \times age)$$

$$\text{(Female) } HRmax = 205 - (0.75 \times age)$$

In this embodiment, the upper limit heart rate during the exercise is set to (the maximum pulse value - 30).

(3) Thereafter, a warming-up Step 1 is started.

Warming-up Step 1 (see Step 1 of FIG. 5)

In order to increase the heart rate in the normal condition before exercising at the target heart rate, a warming-up load is needed.

The exercise load is related to the heart rate, and if one is exercising with the proper intensity, the target heart rate can be achieved. The intensity of the warming-up load required varies depending on the physical strength level of the exerciser.

If the level of physical strength of the exerciser is already known, the target exercise intensity may be determined based on this level. If the physical strength level is unknown, the warming-up is conducted with a standard exercise intensity calculated from data such as the age, sex, the weight and so on of the individual, and a proper exercise intensity can be determined by estimating the physical strength from the heart rate obtained during the warming-up.

Through experiments, the relation between the exercise load of the level required to obtain 50% of the maximum pulse (50% of HRmax) and the age is measured, and the standard exercise intensity is determined from the results thereof as follows:

Formula for the standard exercise load of 50% HRmax $$\text{Step 1 target exercise load} = A1 - (B1 \times \text{age})$$

A1: 10.0

Figure 6:
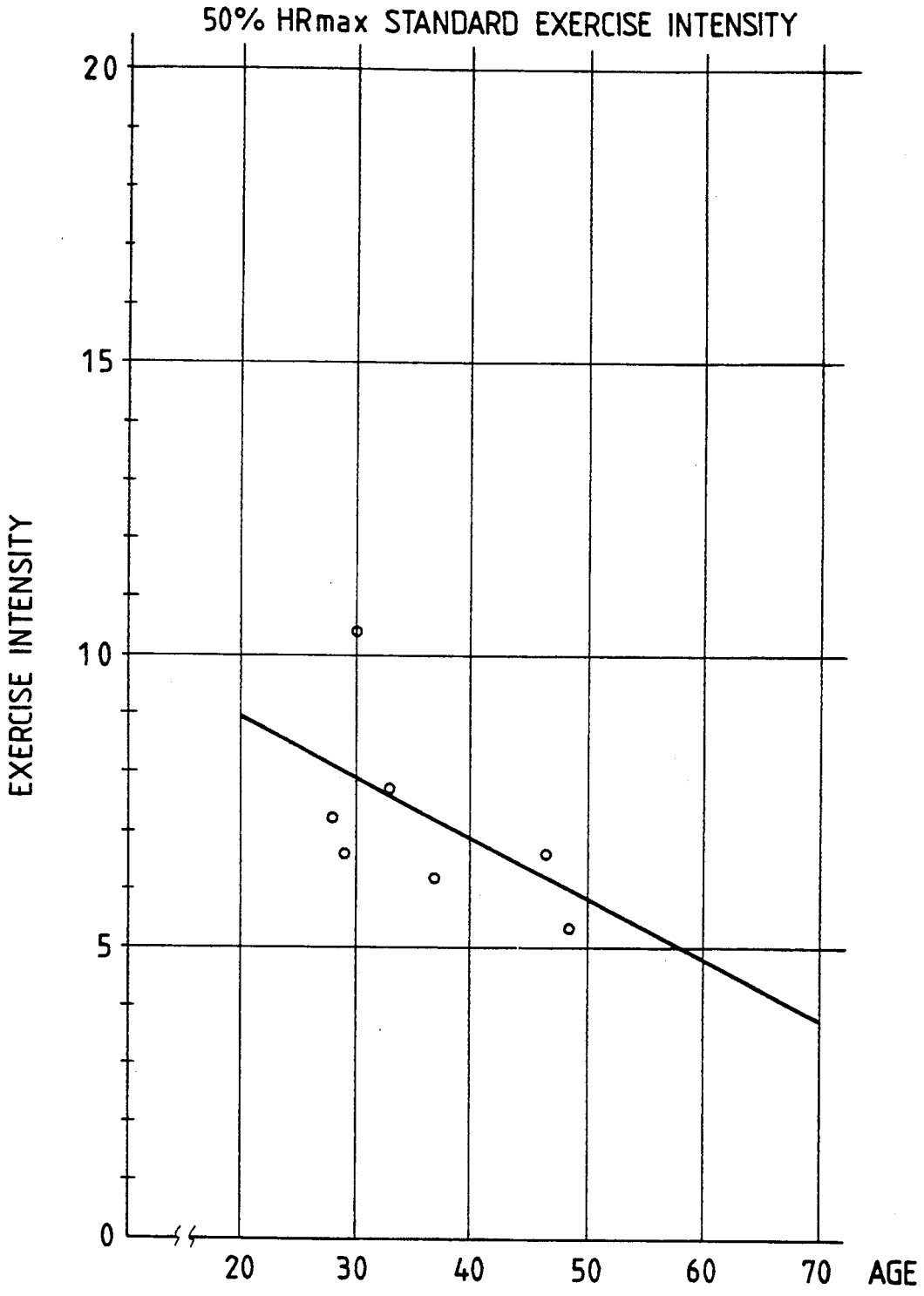
FIG. 6 is a graph showing experimental data.

B1: 0.09 where A1 and B1 are constants obtained through experiments from the age-exercise intensity graph of FIG. 6.

In order to obtain the standard exercise intensity to increments is applied for 3 minutes, and the average heart rate for the last minute of the 3 minute period is measured. From this data, the physical strength is classified into three levels or stages, and the target exercise intensity for warming-up Step 2 is determined.

STEP 1: Gradually-increasing exercise load

Step value = Step 1 target exercise intensity ÷ 18 (step/20 sec.)

The target exercise value of Step 2 for the three physical strength levels or stages are set as follows:

Level 1: Within 3 minutes from the start of the warming-up, the average heart rate enters the target heart rate zone (target pulse ± 5 pulses). The heart rate control processing is started, and Step 2 below is not carried out.

Level 2: 2 to 3 minutes after the start of warm-up, the average heart rate is more than 60% of the maximum heart rate (60% HRmax). Step 2 target exercise intensity = Step 1 target exercise intensity + 5.

Level 3: 2 to 3 minutes after the start of the warming-up, the average pulse is less than 60% of the maximum pulse (60% HRmax). Step 2 target exercise intensity = Step 1 target value + 9.

(4) In order that the exerciser reach the target exercise intensity, obtained in the above Item (3), in 3 minutes, gradually-increasing load at 20 sec. increments is applied to the eddy current load means 3*e*.

(5) When the heart rate of the exerciser exceeds the upper limit heart rate calculated in the above Item (2), the buzzer 4*d* generates an alarm. Further, when the heart rate is above the upper limit heart rate for a predetermined time period, the training is finished.

(6) (i) When the heart rate during the warming-up is greater than the value of the target heart rate minus 5 calculated in the above Item (2), the load level of the eddy current load means 3*e* is decreased by two steps, and the pulse control is started. (ii) In contrast, when the pulse value during the warming-up is smaller than the value of the target pulse value minus 5 calculated in the above Item (2), the gradually-increasing load is applied at 20 sec. increments for 3 minutes, and the average pulse for the last minute of this 3 minute period is measured.

(i) When the above measured average heart rate is greater than the value of 60% of the target exercise intensity set in the above Item (3), the value is changed to a value obtained by adding 5 to this target exercise intensity. (ii) In contrast, when the above measured average heart rate is equal to or smaller than the value of 60% of the target exercise intensity set in the above Item (3), the value is changed to a value obtained by adding 9 to this target exercise intensity.

(7) Then, the warming-up Step 2 is started (see Step 2 of FIG. 5).

Warming-up Step 2 (gradually-increasing exercise load)

In order for the exercise load to increase to the Step 2 target exercise load, changed in the above Item (6), in 5 minutes, the gradually-increasing load applied at 20 sec. increments is controlled by the eddy current load means 3*e*, and the load is increased at the same gradient until the exercise load enters the target heart rate zone.

Step value = Step 2 target exercise load Step 1 target exercise load + 15 (step/20 sec.)

(8) Again, (i) when the heart rate during the exercise is greater than the gradually-increasingly heart rate minus 5, the exercise intensity by the eddy current load means 3*e* is decreased by two steps, and the pulse control is started. (ii) In contrast, when the heart rate during the exercise is smaller than the gradually-increasingly heart rate minus 5, the gradually-increasing load applied at 20 sec. increments is again controlled by the eddy current load means 3*e* so that the exercise intensity by the eddy current load means 3*e* can reach the target exercise intensity, changed in the above Item (6), in 5 minutes.

The step gradually-increasing exercise intensity is obtained by the following formula:

Step gradually-increasing exercise intensity = (Step 2 target exercise intensity − Step 1 target exercise intensity) ÷ 15 (step/20 sec.)

If the value does not become greater than the target heart rate minus 5, the step gradual increase is carried out until it becomes greater than the target heart rate minus 5.

(9) Then, the pulse control is started (see automatic control of FIG. 5).

Pulse control

The pulse value is monitored every 20 seconds, and when it becomes greater than the target pulse minus 5 for the first time, the exercise load at the warming-up is decreased by two steps, and the pulse control is started. At this time, based on the exercised load, the Step 1 exercise load for the pulse control suited for the physical strength level of the exerciser is determined by the following formula:

Exercise load step value for pulse control $$\text{Step value} = (\text{exercise load} \times 0.3) \div 20 \text{ (step/20 sec.)}$$

Exercise load: exercise load when the warming-up is finished.

Thereafter, the pulse value is measured every 20 seconds, and the difference ($\Delta HR = HR - THR$) between the pulse value and the target pulse value is determined. Defining the range of ± 5 with respect to $\Delta HR$ as a dead zone, the control is carried out on the following conditions:

In the case of $\Delta HR > 10$, the exercise intensity is decreased by two steps.

In the case of $5<\Delta HR\leqq 10$, the exercise intensity is decreased by one step.

In the case of $-5>\Delta HR\geqq -10$, the exercise intensity is increased by one step.

In the case of $\Delta HR<-10$, the exercise intensity is increased by two steps.

(10) Then, the cooling-down is started (see cooling-down of FIG. 5).

Cooling-down

When the preset time period has elapsed, or when the start/stop key is pushed, the training is finished after cooling-down for one minute is carried out.

Namely, the exercise intensity is decreased every 20 seconds by one-third of the final exercise intensity in a stepping manner.

The upper limit pulse value is set to the maximum pulse value minus 30, and when the pulse value exceeds this upper limit value, the buzzer 4*d* gives an alarm to the exerciser. Further, when the pulse value is above the upper limit pulse value for more than 20 seconds, the program is forcibly finished.

When the calories consumed is to be displayed by the display device 4*e*, the consumed calories are determined by the following calculation:

Calculation of the consumed calories

The consumed calories are determined by the following formula:

Consumed calories = rotation frequency of eddy current load means × weight (kg) × 9.8 × (1/0.232) × 0.239 (Kcal);

where 9.8: acceleration caused by gravity

1/0.232: exercise efficiency 0.239: calorie per 1 w.

As described above, in the first embodiment of the present invention, the exercise is executed at a constant speed, using the weight load which is the daily exercise load, so that the training can be carried out with a lower physical burden on the exerciser. Also, the target heart rate is set so that the exercise load can be aerobicly effective, and the exercise load can be controlled in such a manner as to maintain this target heart rate.

Further, in accordance with the physical strength level of the exerciser measured at the time of the warming-up, the pulse control is carried out, so that a stable and highly-accurate pulse control can be made.

Further, by varying the target heart rate, various trainings, such as the training for losing the weight and the training for rehabilitation purposes, can be carried out.

Further, by measuring the average exercise intensity during the automatic control, the effects of the training can be confirmed.

As described above, in the step-type training machine according to the first embodiment of the present invention, the driving speed of the crank pedals, which are driven by the right and left feet of the exerciser independently of each other, is adjusted by the load means so as to control the exercise load exerted on the exercise. In this step-type training machine, in order to accurately control the exercise load exerted on the exerciser, there is provided the crank pedal return mechanism having the single spring for maintaining the reaction force of the crank pedal constant, and also there is provided the L-shaped cranks for minimizing variations in the tension of the spring so that the reaction force of the crank pedal can be maintained constant regardless of the exercise position of the exerciser. Therefore, when the reaction force of the crank pedal is measured with the spring removed, due to the position of the center gravity of the L-shaped crank arm, the load acting on the power transmission mechanism (including the chains) is smaller as the position of the crank pedal becomes higher, and is greater as the crank pedal becomes lower. The reaction force of the spring, connected to the end of each chain, and the variation of the above load cancel each other, so that the reaction force of the pedal is maintained constant. Further, since the right and left crank pedals are interconnected via the single spring, the tension of the spring, pulled by the right and left crank pedals when the crank pedals move up and down alternately, is maintained generally constant. Therefore, the durability of the spring is enhanced, providing a step-type training machine of a high quality.

Further, the exercise is executed at a constant speed, using the weight load which is the daily exercise load, and the training can be carried out with a lower physical burden on the exerciser. Also, the target heart rate is set so that the exercise load can be effective as an aerobic exercise, and the exercise load can be controlled in such a manner as to maintain this target heart rate. Particularly, the warming-up step is introduced into the training, and in accordance with the physical strength level of the exerciser measured at the time of the warming-up, the pulse control is carried out, so that a stable and highly-accurate pulse control can be carried out. Therefore, by varying the target heart rate, various trainings, such as the training for losing the weight and the training for rehabilitation purposes, can be carried out.

Further, by measuring the average exercise intensity, etc., during the automatic control, the effects of the training can be confirmed.

Further, the step-type training machine according to the second embodiment of the present invention comprises the frame portion A, the crank pedal portion B, the drive portion C, and the control portion D. The driving speed of the crank pedal portions B, driven up and down by the right and left feet of the exerciser independently of each other, is adjusted by the drive portion C, and the exercise load exerted on the exerciser is controlled by the control portion D. Therefore, the arms, having the steps disposed thereon, can be shortened so that the overall construction of the crank pedal portion B can be very small and compact. Further, the drive portion C for controlling the driving speed of the crank pedal portions B driven up and down independently of each other, is received as a unit within the center frame mounted on the base frame, and therefore a compact construction can also be achieved in this respect. The right and left steps are interconnected via the single spring so that the load of the upward and downward movement of the arms is reduced, and the upward and downward movement of the arms can be performed smoothly.

Further, the driving speed of the crank pedal portions, driven up and down by the right and left feet of the exerciser independently of each other, is adjusted by the load means, so that the exercise load exerted on the exerciser can be accurately controlled. Therefore, the burden on the exerciser is reduced.

Further, the right and left arms are interconnected by the single spring. Therefore, when the arms are moved up and down alternately, the tension of the spring pulled by the right and left arms is kept generally constant. This enhances the durability of the spring, and therefore provides the step-type training machine of a high quality.

Further, the exercise is executed at a constant speed, using the weight load which is the daily exercise load, and the training can be carried out with a lower physical burden on the exerciser. Also, the target heart rate is set so that the exercise load can be aerobicly effective and the exercise load can be controlled in such a manner as to maintain the target heart rate. Particularly, the warming-up step is introduced into the training, and in accordance with the physical strength level of the exerciser measured at the time of the warming-up, the pulse control is carried out, so that stable and highly-accurate heart rate control can be carried out. Therefore, by varying the target pulse, various trainings, such as training for losing weight and for rehabilitation, can be carried out.

Further, by measuring the average exercise intensity, etc., during the automatic control, the effects of the training can be confirmed.

What is claimed is:

1. In a step-type training machine having a pair of left and right crank pedals which are forced in a reciprocating up and down movement by an exerciser and an eddy current load means for exerting a load on said pedals to resist said movement of the pedals, the improvement comprising:

a pair of L-shaped cranks to which each of said pedals are secured at one end thereof, said L-shaped cranks being pivotally secured to said machine to allow said pedals to move up and down; and a crank pedal return mechanism to which said load means exerts a force, said return mechanism including a pair of connectors respectively connected at one end thereof to the other ends of said L-shaped cranks and a spring interconnecting the other ends of said connectors wherein the reaction force of said crank pedals remains constant so as to accurately control the exercise load exerted on the exerciser.

2. The training mechanism of claim 1 wherein said connectors include a pair of chains.

3. A step-type training machine, comprising:

a frame;

a crank pedal portion connected to said frame and being driven by an exerciser between an upper rest position and a lower rest position in a reciprocating manner;

drive means connected to said crank pedal portion for exerting an exercise load thereon so as to control the speed at which said crank pedal portion is driven;

detecting means for continuously detecting the heart rate of said exerciser;

determining means for determining a target heart rate range in accordance with data corresponding to at least the age and sex of the exerciser and for determining the target exercise load in which the detected heart rate is within the target range; and control means for controlling said exercise load based on the thus determined target exercise load, wherein said crank pedal portion includes a pair of right and left crank pedals which are driven up and down by the feet of said exerciser and wherein said drive means comprises:

a drive shaft rotatably supported on said frame;

a fixed sprocket fixedly mounted on one end portion of said drive shaft;

a pair of right and left free wheel sprockets mounted on said drive shaft;

a speed increaser mounted on said frame and including a rotation shaft, a speed increaser sprocket mounted on one end portion of said rotation shaft, and a speed increaser pulley mounted on the other end portion of said rotation shaft;

a first chain circumscribing said fixed sprocket and said speed increaser sprocket;

eddy current load means mounted adjacent said speed increaser and including an input shaft having a timing pulley disposed thereon;

an endless timing belt circumscribing said speed increaser pulley and said timing pulley;

a pair of second chains respectively connected to said crank pedals at one end thereof and engaging said free wheel sprockets wherein up and down movement of said crank pedals causes said drive shaft and said fixed sprocket to rotate, which rotation is transmitted to said speed increaser and said load means via said first chain and said timing belt; and a spring interconnecting said second chains.

4. A step-type training machine according to claim 3 wherein said frame comprises:

a base frame of a generally square shape;

a center frame of a generally cubic shape mounted on said base frame;

a pair of posts vertically mounted on a front portion of said base frame and spaced a predetermined distance from each other; and side guards mounted substantially vertically on a rear portion of said base frame and spaced a predetermined distance from each other, said side guards being bent toward said posts and being connected at their distal ends to upper ends of said posts.

5. A step-type training machine according to claim 3 wherein said crank pedal portion comprises:

brackets mounted on a generally central portion of said frame and spaced a predetermined distance from each other;

a pivot shaft and a link shaft arranged parallel to each other and supported by said brackets;

a pair of right and left arms pivotally mounted at one end thereof to said pivot shaft so as to be pivotally movable up and down;

a pair of right and left links pivotally mounted at one end thereof to said link shaft so as to be pivotally movable up and down; and right and left steps relatively pivotally mounted on the distal ends of said right arm and link and the distal ends of said left arm and link so that the upper surfaces of said steps are always maintained generally horizontal.

6. A step-type training machine according to claim 3 wherein said drive means further comprises:

a spring interconnecting said pair of second chains to one another; and six pulleys provided on said frame around which said spring runs, a first pair of said pulleys being provided at a central portion of said frame, a second pair of said pulleys being provided on opposite sides of said central portion, and a third pair of said pulleys being provided respectively at the right and left sides of a front portion of said frame, whereby said chains can be moved smoothly in response to the upward and downward swinging movement of said right and left crank pedals.

7. A step-type training machine according to claim 3 wherein said control means comprises:

a microcomputer, a pulse detection circuit and an alarm buzzer all disposed in a box mounted on said frame;

a display mounted on the upper surface of said box;

input keys for inputting various data relating to the exerciser;

a rotation frequency detector disposed on the exterior of said box and connected via lead wires to said microcomputer and said pulse detection circuit;

a pulse sensor for sensing the pulse of said exerciser;

a constant current power source; and an interface circuit.

* * * * *